US005816236A

United States Patent [19]

Moroi et al.

[11] Patent Number: 5,816,236

[45] Date of Patent: Oct. 6, 1998

[54] VISCOUS FLUID TYPE HEAT GENERATOR WITH AN ADDITIONAL CHAMBER FOR STORING VISCOUS FLUID

[75] Inventors: Takahiro Moroi; Takashi Ban; Shigeru Suzuki; Kiyoshi Yagi, all of Kariya, Japan

[73] Assignee: Kabushiki Kaisha Toyoda Jidoshokki Seisakusho, Kariya, Japan

[21] Appl. No.: 929,780

[22] Filed: Sep. 15, 1997

[30] Foreign Application Priority Data

Sep. 20, 1996 [JP] Japan ..... 8-250087

[51] Int. Cl.[6] ..... F24C 9/00

[52] U.S. Cl. ..... 126/247; 122/26

[58] Field of Search ..... 126/247; 122/26

[56] References Cited

U.S. PATENT DOCUMENTS 4,365,614 12/1982 Grover ..... 122/26
4,974,778 12/1990 Bertling .

FOREIGN PATENT DOCUMENTS 398107 11/1991 Japan .
9123747 5/1997 Japan .

*Primary Examiner*—Carroll B. Dority
*Attorney, Agent, or Firm*—Burgess, Ryan & Wayne

[57] ABSTRACT

A viscous fluid type heat generator including a housing assembly defining a heat generating chamber and an additional chamber communicated through fluid passageway means with the heat generating chamber, these chambers forming a fluid-tight chamber for accommodating a viscous fluid, and a heat receiving chamber for permitting a heat exchanging fluid to circulate therethrough to receive heat from the heat generating chamber. A rotor element is mounted on a drive shaft for rotation together therewith in the heat generating chamber with a gap defined between the inner wall surfaces of the heat generating chamber and the outer faces of the rotor element. The fluid passageway means includes a fluid withdrawing passageway for withdrawing the viscous fluid from the gap into the additional chamber and a fluid supply passageway for supplying the viscous fluid from the additional chamber into the gap. The fluid withdrawing passageway includes a withdrawing channel formed along one of the inner wall surfaces of the heat generating chamber. The withdrawing channel extends up to and opens to an outer peripheral region of the heat generating chamber to communicate the outer peripheral region with the additional chamber.

19 Claims, 6 Drawing Sheets

VISCOUS FLUID TYPE HEAT GENERATOR WITH AN ADDITIONAL CHAMBER FOR STORING VISCOUS FLUID

BACKGROUND OF THE INVENTION

1. Field of the Invention

The present invention relates to a viscous fluid type heat generator in which a viscous fluid is subjected to a shearing action in a heat generating chamber to generate heat that is in turn transmitted to a heat-transfer or heat-exchange fluid circulating in a heat receiving chamber to be carried by the heat-transfer fluid to a desired area to be heated. More particularly, the present invention relates to a viscous-fluid type heat generator which includes an additional chamber communicated with the heat generating chamber for accommodating a viscous fluid, the amount of which is larger than the capacity of a fluid holding gap defined in the heat generating chamber. The present invention may be embodied, for example, as a supplementary heat source incorporated in an automobile heating system for comfortably heating the passenger compartment of an automobile.

2. Description of the Related Art

Japanese Unexamined Utility Model Publication (Kokai) No. 3-98107 (JP-U-3-98107) discloses a conventional viscous fluid type heat generator incorporated in an automobile heating system, which includes means for adjusting the heat generating performance of the heat generator. The viscous fluid type heat generator disclosed in JP-U-3-98107 includes a housing having mutually opposing front and rear portions which define an inner heat generating chamber and a heat receiving chamber arranged to surround the heat generating chamber. The heat generating chamber is isolated from the heat receiving chamber by a partition wall through which heat is exchanged between a viscous fluid in the heat generating chamber and a heat-exchange fluid in the heat receiving chamber. The heat-exchange fluid is introduced into the heat receiving chamber from an external heating system, and is delivered from the heat receiving chamber to the heating system, so as to be constantly circulated through the heat generator and the heating system.

A drive shaft is rotatably supported in the front and rear portions of the housing by bearings, and a rotor element is fixedly mounted on the shaft in such a manner as to be able to rotate within the heat generating chamber together with the shaft. The rotor element includes outer faces arranged face-to-face with the inner wall surfaces of the heat generating chamber to define therebetween small gaps in the shape of axial labyrinth grooves. The viscous fluid, generally made of a polymeric material, such as silicone oil presenting a high viscosity, is supplied into the heat generating chamber to fill the small gaps between the outer faces of the rotor element and the inner wall surfaces of the heat generating chamber.

The viscous fluid type heat generator of JP-U-3-98107 also includes a viscous fluid reservoir, the casing of which is fixedly attached to the bottom of the generator housing. A diaphragm is supported on the upper inner wall of the reservoir to define therebetween an additional chamber which is connected in such a manner as to be in fluidic communication with the heat generating chamber to permit the viscous fluid to freely flow from one chamber to the other. The heat generating chamber is communicated with the environmental atmosphere through a hole penetrating the top wall of the generator housing, whereby allowing the free flow of the viscous fluid. The diaphragm is selectively shifted between uppermost and lowermost positions by the interaction of a manifold negative pressure and a spring force, both applied onto the back side the diaphragm, to adjust the capacity of the additional chamber.

When the drive shaft of the above viscous fluid type heat generator, incorporated in the automobile heating system, is driven by an automobile engine, the rotor element is also rotated within the heat generating chamber. At this time, if the diaphragm is located at the uppermost position and thus the viscous fluid entirely fills the heat generating chamber, the rotating rotor element provides a shearing action to the viscous fluid held between the inner wall surfaces of the heat generating chamber and the outer faces of the rotor element. The viscous fluid then generates heat due to the shearing force applied thereto. The generated heat is transmitted from the viscous fluid to the heat-exchange water circulating through the heat receiving chamber, and the heat-exchange water carries the transmitted heat to the heating circuit of the automobile heating system.

In the viscous fluid type heat generator of JP-U-3-98107, if the heat generation of the generator is too much and should be reduced or stopped, the diaphragm is shifted toward the lowermost position by applying the manifold negative pressure onto the back side of the diaphragm, whereby transferring the viscous fluid from the heat generating chamber into the additional chamber of the reservoir. Consequently, the heat generation due to the shearing action applied to the viscous fluid is reduced or stopped, and the heating capacity of the automobile heating system is reduced. On the contrary, if the heat generation of the generator is too little and should be increased, the diaphragm is shifted toward the uppermost position by applying the spring force onto the back side of the diaphragm, whereby transferring the viscous fluid from the additional chamber of the reservoir into the heat generating chamber. Consequently, the heat generation due to the shearing force applied to the viscous fluid is increased, and the heating capacity of the automobile heating system is increased.

In the above viscous fluid type heat generator, however, when the viscous fluid is transferred from the heat generating chamber into the additional chamber, fresh environmental air is introduced into the heat generating chamber through the top hole of the housing to compensate for the negative pressure in the heat generating chamber due to the removal of the viscous fluid. Therefore, the viscous fluid comes into contact with the introduced fresh air whenever the viscous fluid is transferred into the additional chamber, i.e., the heat generation is to be decreased. This causes the problems in that the oxidation and degradation of the viscous fluid is accelerated, and that the viscosity of the viscous fluid is affected or decreased due to the addition of water from the atmosphere.

The above problems caused due to the fresh air introduced into the heat generating chamber can be eliminated by forming the heat generating chamber as a fluid-tight chamber. Viscous fluid type heat generators including such a fluid-tight heat generating chamber are well known in the art, and one example is disclosed in the specification of Japanese Patent Application No. 7-217035 that is a co-pending application by the same applicant as the present case. The fluid-tight heat generating chamber does not allow the environmental fresh air to enter therein, and can thus prevent the viscous fluid held therein from coming into contact with the fresh air. Therefore, oxidation and degradation of the viscous fluid is prevented, and the addition of water from the atmosphere into the viscous fluid is avoided.

However, the viscous fluid type heat generator including a fluid-tight heat generating chamber has certain general problems, one being that the viscous fluid is held in a small gap between the inner wall surfaces of the heat generating chamber and the outer faces of the rotor element so that, if a relatively large amount of the viscous fluid is filled into the small gap to improve the heat generation, the volume of the gas in the residual space of the heat generating chamber is minimized and the internal pressure of the heat generating chamber increases to extremely high level when the temperature is high, whereby the sealing ability of shaft sealing members is deteriorated. On the contrary, if the relatively small amount of the viscous fluid is filled into the small gap to ensure the good sealing ability of shaft sealing members, the volume of the gas in the residual space of the heat generating chamber is increased and the heat generation is reduced. Thus, in the viscous fluid type heat generator including a fluid-tight heat generating chamber, it is necessary to strictly manage the amount of the viscous fluid held in the small gap between the inner wall surfaces of the heat generating chamber and the outer faces of the rotor element.

Another problem accompanying the fluid-tight heat generating chamber is that a substantially constant part of the viscous fluid tends to be always subjected to the shearing action in the small gap during the operation of the drive shaft so that the viscous fluid is degraded. The degradation of the viscous fluid may reduce the heat generation of the viscous fluid type heat generator after it is used over a long period. Also, if the drive shaft maintains the high speed rotation during the operation of the viscous fluid type heat generator, the temperature of the viscous fluid in the fluid-tight heat generating chamber rises and the viscous fluid is also degraded when the temperature exceeds the limit of the heat resistant properties of the viscous fluid. Consequently, the amount of the heat generation from the viscous fluid is decreased after the heat generator is operated at high speed.

SUMMARY OF THE INVENTION

Therefore, an object of the present invention is to provide a viscous fluid type heat generator, including a fluid-tight heat generating chamber, which eliminates strict management of the amount of the viscous fluid held in the gap between the inner wall surfaces of the heat generating chamber and the outer faces of the rotor element, and which prevents the reduction of heat genertion due to the degradation of the viscous fluid.

In accordance with the present invention, there is provided a viscous fluid type heat generator comprising: a housing assembly defining therein a heat generating chamber in which heat is generated, an additional chamber communicated through fluid passageway means with the heat generating chamber, and a heat receiving chamber arranged adjacent to the heat generating chamber to permit a heat exchanging fluid to circulate through the heat receiving chamber to thereby receive heat from the heat generating chamber, the heat generating chamber having inner wall surfaces thereof in which the fluid passageway means opens and forming a fluid-tight chamber together with the additional chamber; a drive shaft supported by the housing assembly to be rotatable about an axis of rotation of the drive shaft, the drive shaft being operationally connected to an external rotation-drive source; a rotor element mounted to be rotationally driven by the drive shaft for rotation together with the drive shaft within the heat generating chamber, the rotor element having outer faces confronting the inner wall surfaces of the heat generating chamber via a predetermined gap defined therebetween; and a viscous fluid, held in the gap defined between the inner wall surfaces of the heat generating chamber of the housing assembly and the outer faces of the rotor element, for heat generation by the rotation of the rotor element, and accommodated in the additional chamber of the housing assembly, the viscous fluid being able to flow between the heat generating chamber and the additional chamber through the fluid passageway means; wherein the additional chamber of the housing assembly is designed to accommodate the viscous fluid, an amount of which is larger than a capacity of the gap defined in the heat generating chamber; and wherein the fluid passageway means comprises a fluid withdrawing passageway for withdrawing the viscous fluid from the gap in the heat generating chamber into the additional chamber and a fluid supply passageway for supplying the viscous fluid from the additional chamber into the gap in the heat generating chamber; the fluid withdrawing passageway including a withdrawing channel formed in and along one of the inner wall surfaces of the heat generating chamber of the housing assembly, the withdrawing channel extending up to and opening to an outer peripheral region of the heat generating chamber to communicate the outer peripheral region of the heat generating chamber with the additional chamber.

In this viscous fluid type heat generator, it is preferred that the heat generating chamber defines an annular communication gap portion between a circumferential wall surface of the heat generating chamber and a circumferential face of the rotor element to join opposed gap portions disposed at front and rear sides of the rotor element, and that the withdrawing channel of the fluid withdrawing passageway opens to and confronts the annular communication gap portion.

Also, it is advantageous that the fluid withdrawing passageway opens to a radially center region of the heat generating chamber to communicate the radially center region of the heat generating chamber with the additional chamber.

In this arrangement, the withdrawing channel of the fluid withdrawing passageway may be formed to withdraw a part of the viscous fluid held mainly in the gap in the outer peripheral region of the heat generating chamber when the rotor element rotates at a speed higher than a predetermined rotation speed, while being formed to withdraw a part of the viscous fluid held mainly in the gap in the radially center region of the heat generating chamber when the rotor element rotates at a speed lower than the predetermined rotation speed.

Preferably, the withdrawing channel of the fluid withdrawing passageway has a profile for accelerating a withdrawal of the viscous fluid effected by the rotation of the rotor element from the gap defined in the heat generating chamber into the additional chamber.

To embody this structure, the heat generating chamber may define an annular communication gap portion between a circumferential wall surface of the heat generating chamber and a circumferential face of the rotor element to join opposed gap portions disposed at front and rear sides of the rotor element, and the withdrawing channel of the fluid withdrawing passageway may open to and confront the annular communication gap portion.

In this arrangement, it is preferred that the withdrawing channel of the fluid withdrawing passageway is recessed in the one of inner wall surfaces of the heat generating chamber to open, over substantially the entire length of the withdrawing channel, to the heat generating chamber, and to linearly extend along a center line of the withdrawing channel, the center line being angularly shifted from a radial line of the one inner wall surface in a direction opposed to a rotation direction of the rotor element.

Alternatively, the withdrawing channel of the fluid withdrawing passageway may curve and extend along a center line of the withdrawing channel, the center line being concavely curved from a radial line of the one inner wall surface in a direction opposed to a rotation direction of the rotor element.

Preferably, the withdrawing channel of the fluid withdrawing passageway may be provided with a chamfered opening edge at an upstream side in a rotation direction of the rotor element.

It is also preferred that the fluid withdrawing passageway includes a withdrawing hole opening to a radially center region of the heat generating chamber to communicate the radially center region of the heat generating chamber with the additional chamber, the withdrawing hole being directly communicated with the withdrawing channel.

The fluid supply passageway and the fluid withdrawing passageway may be designed to constantly open a fluidic communication between the heat generating chamber and the additional chamber during the rotation of the rotor element.

Alternatively, at least one of the fluid supply passageway and the fluid withdrawing passageway may be designed to selectively open and close a fluidic communication between the heat generating chamber and the additional chamber during the rotation of the rotor element.

The fluid withdrawing passageway may open to the additional chamber at a position above a fluid level of the viscous fluid accommodated in the additional chamber, and the fluid supply passageway may open to the additional chamber at a position below the fluid level of the viscous fluid accommodated in the additional chamber.

The rotor element may be shaped as a flat plate including a portion extending radially outward from the drive shaft.

Also, the rotor element may include a through hole formed through a radially center region of the rotor element and extending between axially opposed faces of the rotor element.

In accordance with another aspect of the present invention, there is provided a viscous fluid type heat generator comprising: a housing assembly defining therein a heat generating chamber in which heat is generated, an additional chamber communicated through fluid passageway means with the heat generating chamber, and a heat receiving chamber arranged adjacent to the heat generating chamber for permitting a heat exchanging fluid to circulate therethrough to thereby receive heat from the heat generating chamber, the heat generating chamber having inner wall surfaces thereof in which the fluid passageway means opens and forming a fluid-tight chamber together with the additional chamber; a drive shaft supported by the housing assembly to be rotatable about an axis of rotation thereof, the drive shaft being operationally connected to an external rotation-drive source; a rotor element mounted to be rotationally driven by the drive shaft for rotation together therewith within the heat generating chamber,the rotor element having outer faces confronting the inner wall surfaces of the heat generating chamber via a predetermined capacity of gap defined therebetween; and a viscous fluid, held in the gap defined between the inner wall surfaces of the heat generating chamber of the housing assembly and the outer faces of the rotor element, for heat generation by the rotation of the rotor element, and accommodated in the additional chamber of the housing assembly, the viscous fluid being able to flow between the heat generating chamber and the additional chamber through the fluid passageway means; wherein the additional chamber of the housing assembly is designed to accommodate the viscous fluid, an amount of which is larger than the capacity of the gap defined in the heat generating chamber; and wherein the fluid passageway means comprises a fluid withdrawing passageway for withdrawing the viscous fluid from the gap in the heat generating chamber into the additional chamber and a fluid supply passageway for supplying the viscous fluid from the additional chamber into the gap in the heat generating chamber; the fluid withdrawing passageway including a first withdrawing passageway opening to an outer peripheral region of the heat generating chamber and a second withdrawing passageway opening to a radially center region of the heat generating chamber, the first and second withdrawing passageways being directly fluidly communicated with each other, to communicate the outer peripheral region and the radially center region of the heat generating chamber with the additional chamber.

In this viscous fluid type heat generator, it is preferred that the second withdrawing passageway comprises a withdrawing hole opening at one end to the radially center region of the heat generating chamber and at another end to the additional chamber, and that the first withdrawing passageway comprises a withdrawing channel formed in and along one of the inner wall surfaces of the heat generating chamber, the withdrawing channel extending from the withdrawing hole up to the outer peripheral region of the heat generating chamber.

The rotor element may be shaped as a flat plate including a portion extending radially outward from the drive shaft.

Also, the withdrawing channel of the fluid withdrawing passageway may be recessed in the one of the inner wall surfaces of the heat generating chamber to open over substantially the entire length of the withdrawing channel to the heat generating chamber, and linearly extend along a center line of the withdrawing channel, the center line being angularly shifted form a radial line of the one inner wall surface in a direction opposed to a rotation direction of the rotor element.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENTS

Figure 1:
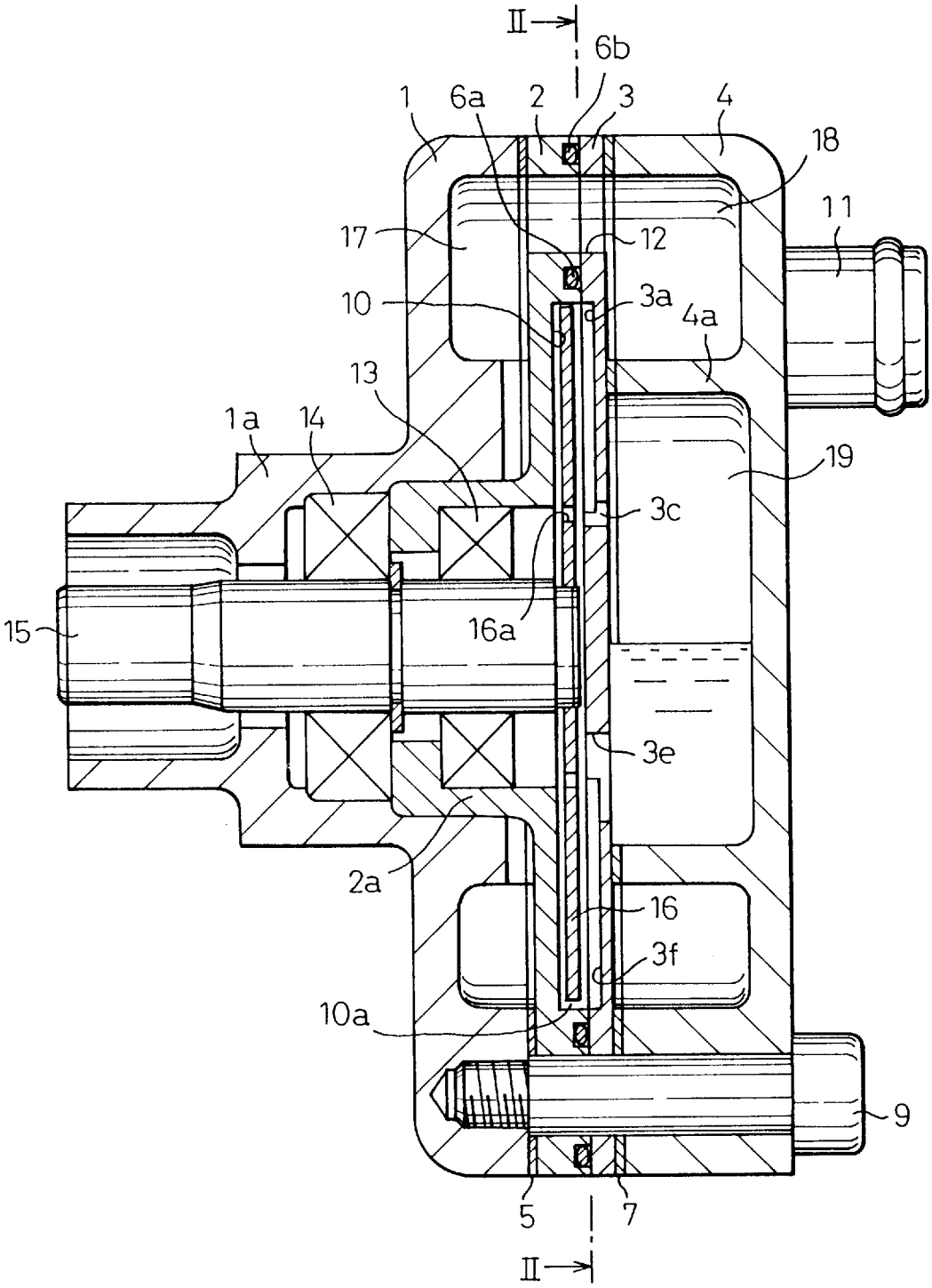
FIG. 1 is a longitudinal sectional view of a first embodiment of a viscous fluid type heat generator according to the present invention, taken along a line I—I of FIG. 2.
Figure 2:
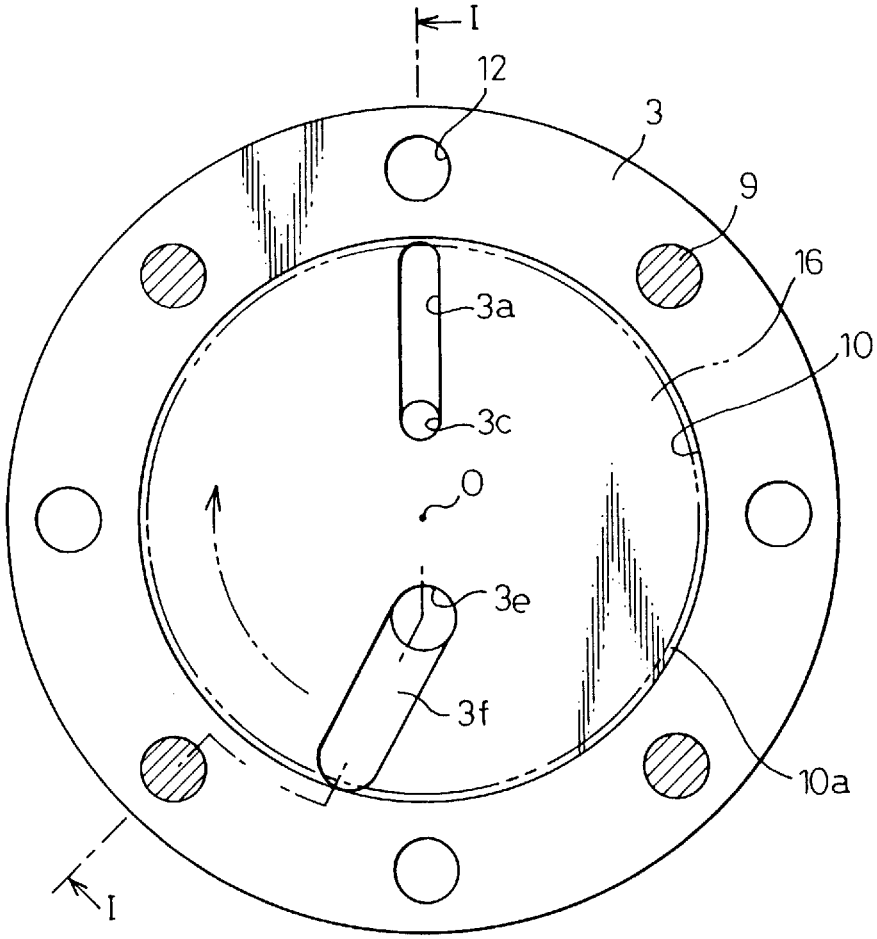
FIG. 2 is a sectional front view of the first embodiment of the viscous fluid type heat generator, taken along a line II—II of FIG. 1.

Referring now to the drawings, wherein the same or similar components are indicated by the same reference numerals, FIGS. 1 and 2 show a first embodiment of a viscous fluid type heat generator according to the present invention. The heat generator of the first embodiment includes a front housing body 1, a front plate element 2, a rear plate element 3 and a rear housing body 4, which are stacked with each other and axially and tightly combined together by a plurality (four, in FIG. 2) of screw bolts 9 to form a housing assembly of the heat generator. A gasket 5 is interposed between the front housing body 1 and the front plate element 2 to hermetically seal therebetween, a pair of O-rings 6*a,* 6*b* are interposed between the front plate element 2 and the rear plate element 3 to hermetically seal therebetween, and a gasket 7 is interposed between the rear plate element 3 and the rear housing body 4 to hermetically seal therebetween.

The front plate element 2 has axially opposed flat front and rear faces, and the rear face is provided with a circular recess formed therein. The rear plate element 3 also has axially opposed flat front and rear faces. A flat circular bottom face and a cylindrical circumferential face of the circular recess formed in the front plate element 2 cooperate with the flat front face of the rear plate element 3 to define a cylindrical heat generating chamber 10. Thus, the flat circular bottom face and the cylindrical circumferential face of the circular recess formed in the front plate element 2 as well as the flat front face of the rear plate element 3 form the inner wall surfaces of the heat generating chamber 10.

The front housing body 1 is provided with an annular recess formed in an inner face of the body 1 at the radially outer region thereof. The inner wall face of the annular recess cooperates with the front face of the front plate element 2 to define an annular front heat receiving chamber 17 arranged near the front side of the heat generating chamber 10. The front heat receiving chamber 17 is separated in a fluid-tight manner from the heat generating chamber 10 by the front plate element 2 interposed therebetween.

The rear housing body 4 is provided with an annular recess formed in an inner face of the body 4 at the outer peripheral region thereof. The rear housing body 4 is also provided with a cylindrical recess formed in the inner face of the body 4 at the center region radially inside the annular recess thereof. The annular peripheral recess of the rear housing body 4 is separated from the cylindrical center recess thereof in a hermetically sealed manner by a cylindrical rib 4*a* which extends axially and is tightly engaged with the gasket 7.

The inner wall face of the annular recess of the body 4, located radially outside the rib 4*a,* cooperates with the rear face of the rear plate element 3 to define an annular rear heat receiving chamber 18 arranged near the rear side of the heat generating chamber 10. The rear heat receiving chamber 18 is separated in a fluid-tight manner from the heat generating chamber 10 by the rear plate element 3 interposed therebetween. The inner wall face of the cylindrical recess of the body 4, located radially inside the rib 4*a,* cooperates with the rear face of the rear plate element 3 to define a cylindrical fluid storing chamber 19 arranged near the rear side of the heat generating chamber 10.

The rear housing body 4 is provided with an inlet port 11 and an outlet port (not shown) disposed side by side on a rear end face of the body 4. Both the inlet port 11 and the outlet port directly communicate with the rear heat receiving chamber 18. The inlet port 11 is provided for introducing heat exchanging liquid, e.g., water, into the front and rear heat receiving chambers 17 and 18. The outlet port is provided for delivering heat exchanging liquid from the front and rear heat receiving chambers 17 and 18 toward the external heating system.

A plurality (four, in FIG. 2) of passages 12 are formed in outer peripheral regions of the front and rear plate elements 2 and 3, to provide a fluid communication between the front and rear heat receiving chambers 17 and 18. The passages 12 are equiangularly arranged and each is positioned between two neighboring screw bolts 9. The passages 12 are separated in a fluid-tight manner from the heat generating chamber 10 by the front and rear plate elements 2 and 3 as well as the O-ring 6*a* provided therebetween.

The front plate element 2 is provided with a boss 2*a* axially and centrally extending from the front face of the element 2. The boss 2*a* defines therein a center recess adjacent and forward of the heat generating chamber 10, for housing a shaft sealing device 13. Further, the front housing body 1 is provided with a boss 1*a* axially and centrally extending from the front face of the body 1. The boss 1*a* defines therein a center recess for housing a bearing unit 14 and fixedly receiving the boss 2*a* of the front plate element 2. A drive shaft 15, typically positioned in a substantially horizontal state, is supported by the shaft sealing device 13 and the bearing unit 14 to be rotatable about a generally horizontal axis of rotation. The shaft sealing device 13 seals, in a fluid-tight manner, the heat generating chamber 10.

A rotor element 16 in the shape of flat circular disc is mounted and tightly fitted on an axial rear end of the drive shaft 15. The rotor element 16 is arranged within the heat generating chamber 10 in such a manner as to be rotatable by the drive shaft 15 about the generally horizontal rotation axis thereof. The rotor element 16 has axially opposed circular faces and a circumferential face, which form the outer faces of the rotor element 16. The outer faces of the rotor element 16 do not come into contact with the inner wall surfaces of the heat generating chamber 10 at any time, and thus define therebetween a relatively small gap for holding a viscous fluid as described later. A plurality of through holes 16*a* are formed in the center region of the rotor element 16 around the drive shaft 15 and extend between the opposed circular faces of the rotor element 16.

The rear plate element 3 is provided with a fluid withdrawing passageway for withdrawing a viscous fluid held in the gap inside the heat generating chamber 10 to the fluid storing chamber 19, and a fluid supply passageway for supplying a viscous fluid stored in the fluid storing chamber 19 to the heat generating chamber 10.

The fluid withdrawing passageway includes a withdrawing channel 3*a* formed on the front face of the rear plate element 3 and a withdrawing hole 3*c* penetrating through the rear plate element 3 between the front and rear faces thereof and directly communicated with the withdrawing channel 3*a*. The withdrawing channel 3*a* opens to the upper region of the heat generating chamber 10 over substantially the entire channel length, and linearly extends in a radial direction at a position above a rotation axis O (see FIG. 2) of the rotor element 16, which coincides with the rotation axis of the drive shaft 15. The upper or radially outer end of the withdrawing channel 3*a* reaches the circumferential wall surface of the heat generating chamber 10, i.e., opens to and confronts the upper region of an annular communication gap portion 10*a* defined between the circumferential wall surface of the heat generating chamber 10 and the circumferential face of the rotor element 16 to join opposed gap portions disposed at front and rear sides of the rotor element 16. The withdrawing hole 3*c* is formed at the lower or radially inner end of the withdrawing channel 3*a* to fluidly communicate the heat generating chamber 10 with the fluid storing chamber 19. The withdrawing hole 3*c* may periodically confront one of the through holes 16*a* formed in the rotor element 16 upon the rotation thereof.

The fluid supply passageway includes a supply channel 3*f* formed on the front face of the rear plate element 3 and a supply hole 3*e* penetrating through the rear plate element 3 between the front and rear faces thereof. The width of the supply channel 3*f* is larger than that of the withdrawing channel 3*a,* and the diameter of the supply hole 3*e* is larger than that of the withdrawing hole 3*c*. The supply channel 3*f* opens to the lower region of the heat generating chamber 10, and linearly extends in an angled radial direction at a position below the rotation axis O of the rotor element 16. That is, the supply channel 3*f* has a center line angularly shifted from a radial line in a direction corresponding to the direction of rotation of the rotor element 16. The lower or radially outer end of the supply channel 3*f* reaches the circumferential wall surface of the heat generating chamber 10, i.e., opens to and confronts the lower region of the annular communication gap portion 10*a*. The supply hole 3*e* is formed at the upper or radially inner end of the supply channel 3*f* to fluidly communicate the heat generating chamber 10 with the fluid storing chamber 19. The supply hole 3*e* may periodically confront one of the through holes 16*a* formed in the rotor element 16 upon the rotation thereof.

The heat generating chamber 10 and the fluid storing chamber 19 communicated with the heat generating chamber 10 form a fluid-tight chamber for accommodating the viscous fluid. More specifically, the gap defined between the inner wall surfaces of the heat generating chamber 10 and the outer faces of the rotor element 16 and the fluid storing chamber 19 are constantly filled with the viscous fluid, such as a silicone oil, and a gaseous material. In the viscous fluid type heat generator of the first embodiment, the capacity of the fluid storing chamber 19 is designed to be larger than the capacity of the fluid holding gap defined in the heat generating chamber 10. Therefore, it is possible to select the amount of the viscous fluid supplied to the fluid-tight chamber in such a manner as to be larger than the capacity of the gap but smaller than the total capacity of the gap plus the fluid storing chamber 19, which eliminates a strict management or a precise determination of the amount of the viscous fluid to be held in the gap.

It should be noted that, in the heat generator of the first embodiment, the residual space defined inside the boss 2*a* adjacent forward the heat generating chamber 10 may accommodate a certain amount of the viscous fluid, but it does not contribute to heat generation by the viscous fluid, so that it is disregarded in the above and below description to simplify the description.

The drive shaft 15 is formed to be connected to a rotational drive source, such as an automobile engine, via a pulley or a solenoid clutch mounted on a front end of the drive shaft 15 by e.g., bolts (not shown), and to be driven by the rotational drive source.

When the viscous fluid type heat generator of the first embodiment is incorporated in the heating system of an automobile, and when the drive shaft 15 is driven by an automobile engine via, e.g., a belt and pulley transmission mechanism, the rotor element 16 is rotated within the cylindrical fluid-tight heat generating chamber 10. Therefore, the viscous fluid such as silicone oil held in the gap between the inner wall surfaces of the heat generating chamber 10 and the outer faces of the rotor element 16 is subjected to a shearing action by the rotation of the rotor element 16. Consequently, the viscous fluid such as silicone oil generates heat, which is transmitted to the heat exchanging liquid, typically water, flowing through the front and rear heat receiving chambers 17 and 18. Then, the heat is carried by the heat exchanging liquid to a heating circuit of the heating system to warm an objective area of the automobile, such as a passenger compartment.

In the heat generator of the first embodiment, before the drive shaft 15 is driven by the automobile engine or when the drive shaft 15 stops, the viscous fluid supplied into the fluid holding gap in the heat generating chamber 10 and the fluid storing chamber 19 is in a condition of having the same fluid level therein by the effect of gravity on the viscous fluid, and thus the amount of the gaseous material which has a low viscosity in the heat generating chamber is relatively large. Thus, when the drive shaft 15 is started to be driven, the amount of the viscous fluid to be subjected to the shearing action in the gap by the rotation of the rotor element 16 is relatively small, so that it is possible to start to rotate the rotor element 16 by a relatively small torque. That is, the heat generator of the first embodiment is subjected to a relatively small starting shock due to the starting torque applied to the rotor element 16.

After the drive shaft 15 is started to be driven by the automobile engine, the viscous fluid such as silicone oil tends to be collected in the radially inner region of the heat generating chamber 10, i.e., the generally center region of the flat disc-shaped rotor element 16 where the through holes 16*a* are formed, by the Weissenberg effect as well as by the movement of the gaseous material. Especially, it has been found that, when the drive shaft 15 is rotated at a speed lower than a predetermined rotation speed, the Weissenberg effect is stronger than the centrifugal force applied to the viscous fluid.

Further, because the fluid storing chamber 19 communicates with the heat generating chamber 10 via the withdrawing hole 3*c* and the supply hole 3*e* formed in the rear plate element 3, the viscous fluid collected in the radially inner region of the heat generating chamber 10 can be withdrawn from the heat generating chamber 10 into the fluid storing chamber 19 through the withdrawing channel 3*a* and the withdrawing hole 3*c,* and the viscous fluid stored in the fluid storing chamber 19 can be supplied therefrom into the heat generating chamber 10 through the supply channel 3*f* and the supply hole 3*e*.

In this manner, the viscous fluid type heat generator of the first embodiment can establish the automatic replacement of the viscous fluid to be subjected to the shearing action in the heat generating chamber 10 by the viscous fluid stored in the fluid storing chamber 19 in a continuous manner during the rotation of the rotor element 16.

Particularly, in the case that the drive shaft 15 is rotated at the lower speed, the viscous fluid such as silicone oil is likely to pass through the through holes 16*a* in the rotor element 16, each of which can confront the withdrawing hole 3*c* of the supply hole 3*e* in the rear plate element 3, and to move between the opposed gap portions of the front and rear sides of the rotor element 16, under the predominant Weissenberg effect. In this arrangement, it is also possible to dispose a fluid storing chamber at the front side of the heat generating chamber.

On the other hand, when the drive shaft 15 is rotated at a speed higher than the predetermined rotation speed, the viscous fluid such as silicone oil is likely to extend to the radially outer region of the fluid holding gap in the heat generating chamber 10, due to the centrifugal force which becomes stronger than the Weissenberg effect.

When the amount of the viscous fluid supplied to the heat generating chamber 10 is made larger than the amount of the viscous fluid withdrawn into the fluid storing chamber 19 by suitably adjusting the cross-sectional areas of the withdrawing channel 3*a,* the withdrawing hole 3*c,* the supply channel 3*f* and the supply hole 3*e,* it is possible to increase the amount of the viscous fluid such as silicone oil held in the gap between the inner wall surfaces of the heat generating chamber 10 and the outer faces of the rotor element 16 when the latter is rotating, and to thereby augment the heat generation in the gap.

As described above, the fluid storing chamber 19 can store the viscous fluid whose volume is larger than the capacity of the fluid holding gap defined in the heat generating chamber 10, and the viscous fluid held in the gap defined in the heat generating chamber 10 can be constantly replaced and refreshed by the viscous fluid stored in the fluid storing chamber 19, so that the same viscous fluid is not always subjected to the shearing action within the heat generating chamber 10, and accordingly, the thermal degradation of the viscous fluid, due to constant heat generation, can be suppressed.

Particularly, in the viscous fluid type heat generator of the first embodiment, the withdrawing channel 3*a* recessed into the front face of the rear plate element 3 linearly extends in a radial direction at a position above the rotation axis O of the rotor element 16 to the circumferential wall surface of the heat generating chamber 10. This arrangement of the withdrawing channel 3*a* enables the viscous fluid such as silicone oil extending to the radially outer region of the fluid holding gap in the heat generating chamber 10, especially the viscous fluid flowing along the annular communication gap portion 10*a,* under the predominant centrifugal force especially when the rotor element 16 rotates at a higher speed, to be surely and easily captured by the withdrawing channel 3*a* and be withdrawn from the fluid holding gap into the fluid storing chamber 19 through the withdrawing channel 3*a* and the withdrawing hole 3*c*. This is because, when the rotor element 16 rotates at a higher speed, the circumferential flow rate of the viscous fluid flowing to follow the rotating rotor element 16 is larger at the outer circumferential region of the fluid holding gap, and the fluid pressure generated inside the withdrawing channel 3*a* is higher at the radially outer region than at the radially inner region of the channel 3*a*.

As discussed above, in the viscous fluid type heat generator of the first embodiment, the withdrawing hole 3*c* arranged and opened at the radially inner or generally center region of the heat generating chamber 10 serves to withdraw the viscous fluid from the fluid holding gap in the heat generating chamber 10 into the fluid storing chamber 19, under the predominant Weissenberg effect when the rotor element 16 rotates at a lower speed, while the withdrawing channel 3*a* serves to effectively capture the viscous fluid in the fluid holding gap, under the predominant centrifugal force when the rotor element 16 rotates at a higher speed. Consequently, the heat generator of the first embodiment makes it possible to surely withdraw the viscous fluid from the fluid holding gap in the heat generating chamber 10 into the fluid storing chamber 19, irrespective of the rotation speed of the rotor element 16.

Also, in the viscous fluid type heat generator of the first embodiment, because the viscous fluid to be subjected to the shearing action in the heat generating chamber 10 can be surely and easily replaced by the viscous fluid stored in the fluid storing chamber 19 in a continuous manner during the rotation of the rotor element 16, a suitable amount of the fresh viscous fluid can be supplied into the gap in the heat generating chamber 10 so as to allow a sufficient amount of heat to be generated in the heat generating chamber 10. Further, the fluid storing chamber 19 having relatively large volume allows the thermal expansion of the viscous fluid and the gaseous material accommodated in the fluid-tight chamber formed by the heat generating chamber 10 and the fluid storing chamber 19, so as to ensure and maintain a sufficient sealing ability of the shaft sealing device 13.

It should be noted that the viscous fluid such as silicone oil, held in the gap in the heat generating chamber 10, normally contains gaseous component as bubbles, during the rotation of the rotor element 16 for applying the shearing action to the viscous fluid. Therefore, it is preferred that the withdrawing hole 3*c* is formed to open on the rear face of the rear plate element 3 at a position above the fluid level of the viscous fluid stored in the fluid storing chamber 19 during at least the rotation of the rotor element 16, to facilitate the escape of the gaseous component from the viscous fluid in the heat generating chamber 10 into the fluid storing chamber 19. Such an arrangement of the withdrawing hole 3*c* can also facilitate the replacement of the viscous fluid between the heat generating chamber 10 and the fluid storing chamber 19, mainly due to the weight of the viscous fluid.

On the other hand, the arrangement of the supply channel 3*f* and the supply hole 3*e,* at a position below the fluid level of the viscous fluid stored in the fluid storing chamber 19, can facilitate the introduction of the viscous fluid in the fluid storing chamber 19 into the heat generating chamber 10 by the rotor element 16 rotating in the heat generating chamber 10, under the influence of a stretching viscosity of the viscous fluid, especially of a viscoelastic fluid such as silicone oil.

Further, when the operation of the drive shaft 15 in the viscous fluid type heat generator of the first embodiment is suspended, the viscous fluid such as silicone oil and the gaseous material can freely move in the fluid-tight chamber formed by the heat generating chamber 10 and the fluid storing chamber 19, mainly due to the weight of the viscous fluid, so as to equalize the fluid level of the viscous fluid accommodated in both chambers 10 and 19.

Yet further, in the viscous fluid type heat generator of the first embodiment, the fluid-tight chamber formed by the heat generating chamber 10 and the fluid storing chamber 19 serves to prevent the viscous fluid such as silicone oil accommodated in both chambers 10 and 19 coming into contact with the fresh atmospheric gas, and thus eliminates the addition of water contained in the atmosphere to the viscous fluid. Accordingly, it is possible to solve the problems of the degradation of the viscous fluid due to the contact with fresh atmospheric gas.

Figure 3:
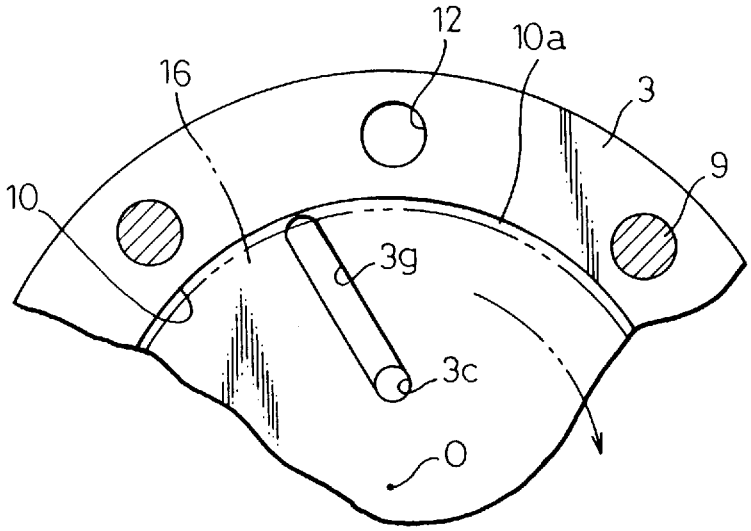
FIG. 3 is a sectional front view, similar to FIG. 2, of a part of a second embodiment of a viscous fluid type heat generator according to the present invention.

FIG. 3 shows the characteristic portion of a second embodiment of a viscous fluid type heat generator according to the present invention. In this viscous fluid type heat generator, the rear plate element 3 is provided with a fluid withdrawing passage including a withdrawing channel 3*g* formed on the front face of the rear plate element 3 and a withdrawing hole 3*c* penetrating through the rear plate element 3 between the front and rear faces thereof. The withdrawing channel 3*g* opens to the upper region of the heat generating chamber 10 over substantially the entire channel length, and linearly extends in an angled radial direction at a position above the rotation axis O of the rotor element 16. That is, the withdrawing channel 3*g* has a center line angularly shifted from a radial line in a direction opposed to the direction of rotation of the rotor element 16. The upper or radially outer end of the withdrawing channel 3*g* opens to and confronts the upper region of the annular communication gap portion 10*a* defined in the heat generating chamber 10. The withdrawing hole 3*c* is formed at the lower or radially inner end of the withdrawing channel 3*g* to fluidly communicate the heat generating chamber 10 with the fluid storing chamber 19 (FIG. 1). The other construction of the heat generator of the second embodiment is identical to the heat generator of the first embodiment, and thus is not described in detail.

In the viscous fluid type heat generator of the second embodiment, the withdrawing channel 3*g,* linearly extending in an angled radial direction at the position above the rotation axis O of the rotor element 16 to the circumferential wall surface of the heat generating chamber 10, enables the viscous fluid such as silicone oil, extending to the radially outer region of the fluid holding gap in the heat generating chamber 10 under the centrifugal force, to be more surely and easily captured by the withdrawing channel 3*g* and withdrawn from the fluid holding gap into the fluid storing chamber 19 through the withdrawing channel 3*g* and the withdrawing hole 3*c*. This is because the viscous fluid flowing in the outer circumferential region of the fluid holding gap and captured by the withdrawing channel 3*g* tends to flow along the angled inner wall of the channel 3*g,* and thus is withdrawn into the fluid storing chamber 19 in a more positive fashion than in the first embodiment.

Figure 4:
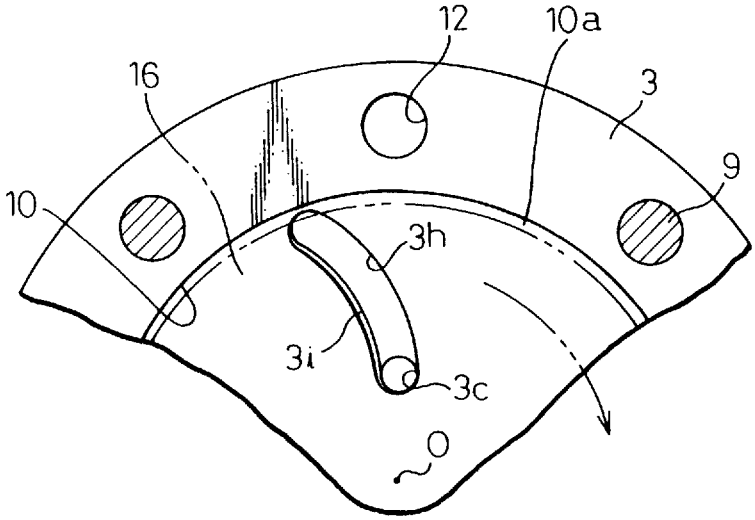
FIG. 4 is a sectional front view, similar to FIG. 2, of a part of a third embodiment of a viscous fluid type heat generator according to the present invention.

FIG. 4 shows the characteristic portion of a third embodiment of a viscous fluid type heat generator according to the present invention. In this viscous fluid type heat generator, the rear plate element 3 is provided with a fluid withdrawing passage including a withdrawing channel 3*h* formed on the front face of the rear plate element 3 and a withdrawing hole 3*c* penetrating through the rear plate element 3 between the front and rear faces thereof. The withdrawing channel 3*h* opens to the upper region of the heat generating chamber 10 over substantially the entire channel length, and curves and extends in a radial direction at a position above the rotation axis O of the rotor element 16. That is, the withdrawing channel 3*h* has a center line concavely curved from a radial line in a direction opposed to the direction of rotation of the rotor element 16. The upper or radially outer end of the withdrawing channel 3*h* opens to and confronts the upper region of the annular communication gap portion 10*a* defined in the heat generating chamber 10. The withdrawing hole 3*c* is formed at the lower or radially inner end of the withdrawing channel 3*h* to fluidly communicate the heat generating chamber 10 with the fluid storing chamber 19 (FIG. 1).

Figure 5:
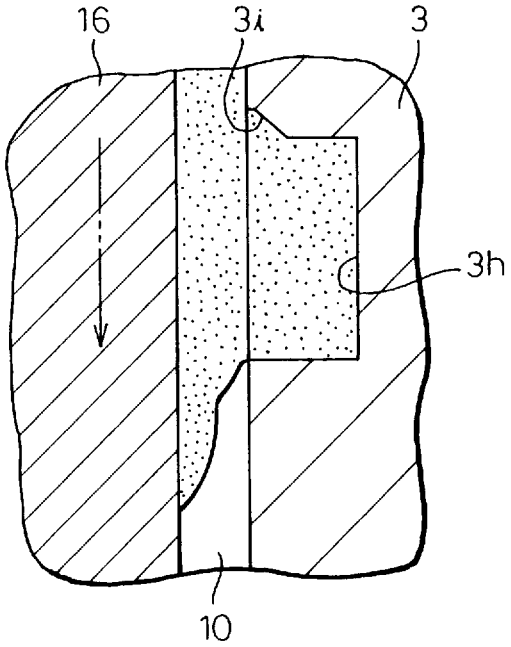
FIG. 5 is a partially enlarged sectional view of the third embodiment of the viscous fluid type heat generator.

Also, in the heat generator of the third embodiment, the withdrawing channel 3*h* is provided with a chamfered edge 3*i* (see FIG. 5) at an inner arc side, i.e., an upstream side in the direction of rotation of the rotor element 16, of the opening edge of the channel 3*h*. The other construction of the heat generator of the third embodiment is also identical to the heat generator of the first embodiment, and thus is not described in detail.

In the viscous fluid type heat generator of the third embodiment, the withdrawing channel 3*h,* curved and extending in a radial direction at a position above the rotation axis O of the rotor element 16 to the circumferential wall surface of the heat generating chamber 10, enables the viscous fluid such as silicone oil, extending to the radially outer region of the fluid holding gap in the heat generating chamber 10 under the centrifugal force, to be more surely and easily captured by the withdrawing channel 3*h* and withdrawn from the fluid holding gap into the fluid storing chamber 19 through the withdrawing channel 3*h* and the withdrawing hole 3*c,* in the same manner as in the withdrawing channel 3*g* of the second embodiment. Further, in the heat generator of the third embodiment, the viscous fluid is smoothly introduced into the withdrawing channel 3*h* through the chamfered edge 3*i* while being surely captured by an opposed acute edge of the withdrawing channel 3*h*. This facilitates the capturing and withdrawal of the viscous fluid by the withdrawing channel 3*h*.

Figure 6:
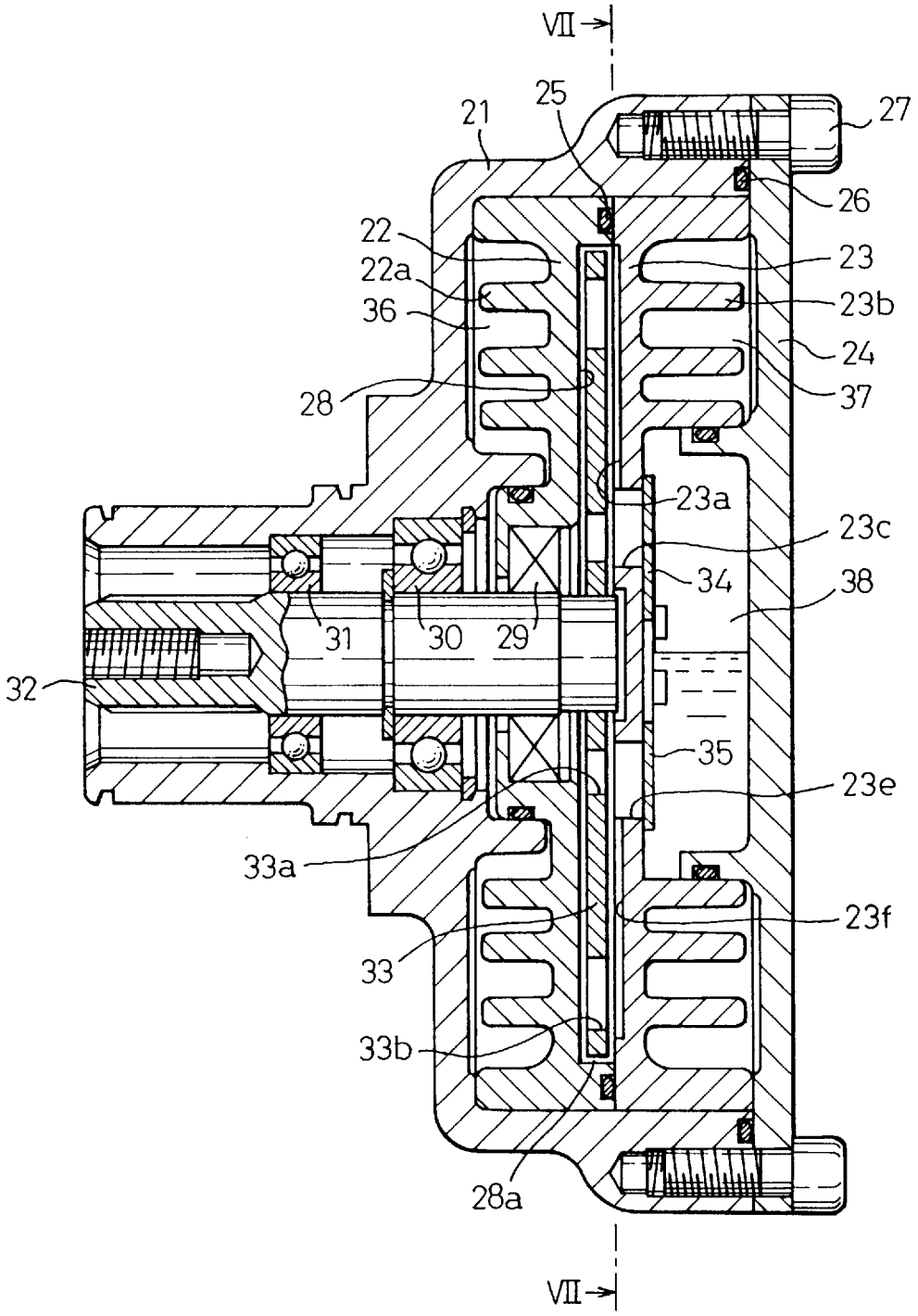
FIG. 6 is a longitudinal sectional view of a fourth embodiment of a viscous fluid type heat generator according to the present invention, taken along a line VI—VI of FIG. 7.
Figure 7:
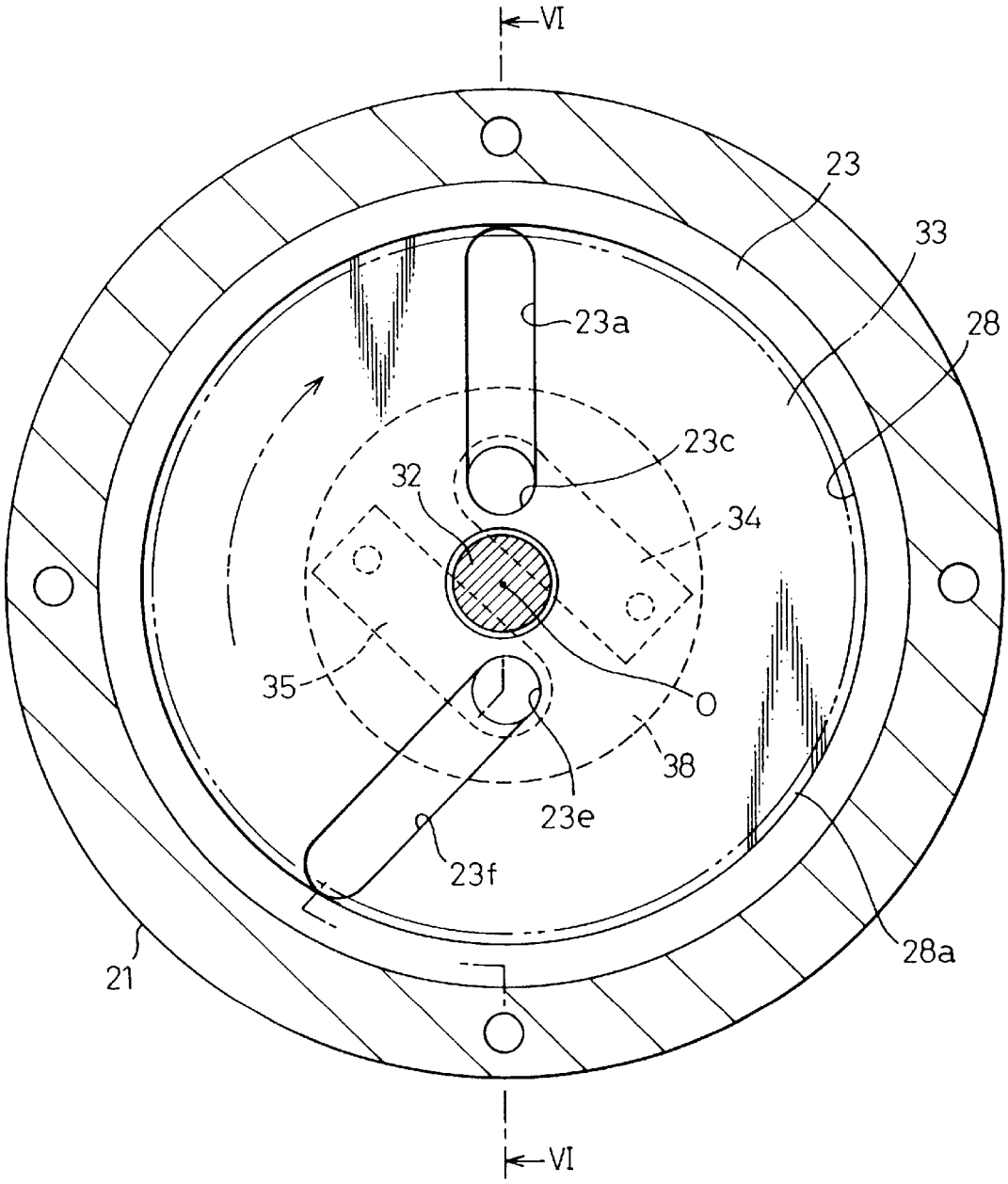
FIG. 7 is a sectional front view, similar to FIG. 2, of the fourth embodiment of the viscous fluid type heat generator, taken along a line VII—VII of FIG. 6.

FIGS. 6 and 7 show a fourth embodiment of a viscous fluid type heat generator according to the present invention. The heat generator of the fourth embodiment includes a cup-shaped front housing body 21, a front plate element 22, a rear plate element 23 and a plate-shaped rear housing body 24. The front and rear plate elements 22, 23 are stacked with each other through the interposition of an O-ring 25 hermetically sealing therebetween, and housed inside the front housing body 21. The front housing body 21 is closed at a rear opening end thereof by the rear housing body 24 through the interposition of an O-ring 26 hermetically sealing therebetween, and axially and tightly combined with the rear housing body 24 by a plurality of screw bolts 27. The front and rear housing bodies 21, 24 and the front and rear plate elements 22, 23 form a housing assembly of the heat generator.

The front plate element 22 has axially opposed front and rear faces, and the flat rear face is provided with a circular recess formed therein. The rear plate element 23 also has axially opposed front and rear faces. A flat circular bottom face and a cylindrical circumferential face of the circular recess formed in the front plate element 22 cooperate with the flat front face of the rear plate element 23 to define a cylindrical heat generating chamber 28. Thus, the flat circular bottom face and the cylindrical circumferential face of the circular recess formed in the front plate element 22 as well as the flat front face of the rear plate element 23 forms the inner wall surfaces of the heat generating chamber 28.

The front face of the front plate element 22 is provided with a plurality of fins 22*a* axially frontwardly projecting and concentrically extending in a radially outer region of the front face. The front housing body 21 is provided with an annular recess formed therein at a radially outer region thereof. The inner wall face of the annular recess of the front housing body 21 cooperates with the front face of the front plate element 22 involving the faces of the fins 22*a* to define an annular front heat receiving chamber 36 arranged near the front side of the heat generating chamber 28. The front heat receiving chamber 36 is separated in a fluid-tight manner from the heat generating chamber 28 by the front plate element 22 interposed therebetween.

The rear face of the rear plate element 23 is also provided with a plurality of fins 23*b* axially rearwardly projecting and concentrically extending in a radially outer region of the rear face. The rear housing body 24 is provided with an annular rib axially frontwardly projecting from an inner face of the body 24. The inner face portion of the body 24, located radially outside the annular rib, cooperates with the rear face of the rear plate element 23 involving the faces of the fins 23*b* to define an annular rear heat receiving chamber 37 arranged near the rear side of the heat generating chamber 28. The rear heat receiving chamber 37 is separated in a fluid-tight manner from the heat generating chamber 28 by the rear plate element 23 interposed therebetween.

Further, the inner face portion of the rear housing body 24, located radially inside the annular rib, cooperates with the rear face of the rear plate element 23 to define a cylindrical heat generation control chamber 38 arranged near the rear side of the heat generating chamber 28. The heat generation control chamber 38 is separated from the rear heat receiving chamber 37 in a hermetically sealed manner by the annular rib which is tightly engaged with a radially innermost fin 23*b* of the rear plate element 23.

The front housing body 21 is provided with inlet and outlet ports (not shown) disposed side by side on an outer face of the body 21. Both the inlet and outlet ports directly communicate with the front and rear heat receiving chambers 36 and 37. The inlet port is provided for introducing heat exchanging liquid, e.g., water, into the front and rear heat receiving chambers 36 and 37, and the outlet port is provided for delivering heat exchanging liquid from the front and rear heat receiving chambers 36 and 37 toward the external heating system.

The front plate element 22 is provided with a center boss axially extending from the front face of the element 22, which defines therein a center recess adjacent and forward the heat generating chamber 28, for housing a shaft sealing device 29. Also, the front housing body 21 is provided with a center boss axially extending from the front face of the body 21, which defines therein a center recess for housing a pair of bearing units 30 and 31 and fixedly receiving the center boss of the front plate element 22. A drive shaft 32, typically positioned in a substantially horizontal state, is supported by the shaft sealing device 29 and the bearing units 30, 31 to be rotatable about a generally horizontal axis of rotation. The shaft sealing device 29 seals in a fluid-tight manner the heat generating chamber 28.

A rotor element 33 in the shape of flat circular disc is mounted and tightly fitted on an axial rear end of the drive shaft 32. The rotor element 33 is arranged within the heat generating chamber 28 in such a manner as to be rotatable by the drive shaft 32 about the generally horizontal rotation axis thereof. The rotor element 33 has axially opposed circular faces and a circumferential face, which form the outer faces of the rotor element 33. The outer faces of the rotor element 33 do not come into contact with the inner wall surfaces of the heat generating chamber 28 at any time, and thus define therebetween a relatively small gap for holding a viscous fluid as described later.

A plurality of through holes 33*a* are formed in the radially inner region of the rotor element 33 and extend between the opposed circular faces of the rotor element 33, to fluidly communicate the opposed gap portions of the front and rear sides of the rotor element 33 with each other. Also, a plurality of through holes 33*b* are formed in the radially outer region of the rotor element 33 and extend between the opposed circular faces of the rotor element 33, to increase the amount of heat generation due to a shearing action applied to the viscous fluid by the rotor element 33 rotating in the heat generating chamber 28.

The rear plate element 23 is provided with a fluid withdrawing passageway for withdrawing a viscous fluid held in the gap inside the heat generating chamber 28 to the heat generation control chamber 38, and a fluid supply passageway for supplying a viscous fluid stored in the heat generation control chamber 38 to the heat generating chamber 28.

The fluid withdrawing passageway includes a withdrawing channel 23*a* formed on the front face of the rear plate element 23 and a withdrawing hole 23*c* penetrating through the rear plate element 23 between the front and rear faces thereof. The withdrawing channel 23*a* opens to the upper region of the heat generating chamber 28 over substantially the entire channel length, and linearly extends in a radial direction at a position above a rotation axis O of the rotor element 33, which coincides with the rotation axis of the drive shaft 32 (see FIG. 7). The upper or radially outer end of the withdrawing channel 23*a* reaches the circumferential wall surface of the heat generating chamber 28, i.e., it opens to and confronts the upper region of an annular communication gap portion 28*a* defined between the circumferential wall surface of the heat generating chamber 28 and the circumferential face of the rotor element 33 to join the opposed gap portions disposed at front and rear sides of the rotor element 33. The withdrawing hole 23*c* is formed at the lower or radially inner end of the withdrawing channel 23*a* to fluidly communicate the heat generating chamber 28 with the heat generation control chamber 38. The withdrawing hole 23*c* may periodically confront one of the through holes 33*a* formed in the rotor element 33 upon the rotation thereof.

The fluid supply passageway includes a supply channel 23*f* formed on the front face of the rear plate element 23 and a supply hole 23*e* penetrating through the rear plate element 23 between the front and rear faces thereof. The width of the supply channel 23*f* is identical to that of the withdrawing channel 23*a,* and the diameter of the supply hole 23*e* is identical to that of the withdrawing hole 23*c.* The supply channel 23*f* opens to the lower region of the heat generating chamber 28, and linearly extends in an angled radial direction at a position below the rotation axis O of the rotor element 33. That is, the supply channel 23*f* has a center line angularly shifted from a radial line in a direction corresponding to the direction of rotation of the rotor element 33. The lower or radially outer end of the supply channel 23*f* reaches the circumferential wall surface of the heat generating chamber 28, i.e., opens to and confronts the lower region of the annular communication gap portion 28*a*. The supply hole 23*e* is formed at the upper or radially inner end of the supply channel 23*f* to fluidly communicate the heat generating chamber 28 with the heat generation control chamber 38. The supply hole 23*e* may periodically confront one of the through holes 33*a* formed in the rotor element 33 upon the rotation thereof.

The heat generating chamber 28 and the heat generation control chamber 38, which is selectively communicated with the heat generating chamber 28 as described later, form a fluid-tight chamber for accommodating a viscous fluid. More specifically, the gap, defined between the inner wall surfaces of the heat generating chamber 28 and the outer faces of the rotor element 33, and the heat generation control chamber 38 are constantly filled with a viscous fluid, such as a silicone oil, and a gaseous material. In the heat generator of the fourth embodiment, the capacity of the heat generation control chamber 38 is designed to be larger than the capacity of the fluid holding gap defined in the heat generating chamber 28. Therefore, it is possible to select the amount of the viscous fluid supplied in the fluid-tight chamber in such a manner as to be larger than the capacity of the gap but smaller than the total capacity of the gap plus the heat generation control chamber 38, which eliminates a strict management or a precise determination of the amount of the viscous fluid to be held in the gap.

It should be noted that, in the heat generator of the fourth embodiment, the residual space defined inside the center boss adjacent forward the heat generating chamber 28 may accommodate a certain amount of the viscous fluid, but it does not contribute to heat generation by the viscous fluid, so that it is disregarded in the above and below description to simplify the description.

Further, in the heat generator of the fourth embodiment, a pair of flap valves 34 and 35, each having a bimetal structure, are mounted on the center region of the rear face of the rear plate element 23 to be arranged within the heat generation control chamber 38. The flap valve 34 is fixed at one end thereof to the rear plate element 23, and is located so as to selectively open and close the withdrawing hole 23*c* by the other end of the flap valve 34 in response to the temperature change in the heat generation control chamber 38. The flap valve 35 is also fixed at one end thereof to the rear plate element 23, and is located so as to selectively open and close the supply hole 23*e* by the other end of the flap valve 35 in response to the temperature change in the heat generation control chamber 38. More specifically, when the temperature of the viscous fluid and gaseous material in the heat generation control chamber 38 rises above a predetermined level, the flap valve 34 is designed to open the withdrawing hole 23*c* while the flap valve 35 is designed to close the supply hole 23*e*. Of course, the threshold of the temperature to shift the flap valves 34, 35 may be variously adjusted by selecting the material of the flap valves.

The drive shaft 32 is formed to be connected to a rotational drive source, such as an automobile engine, via a pulley or a solenoid clutch mounted on a front end of the drive shaft 32 by, e.g., bolts (not shown), and to be driven by the rotational drive source.

When the viscous fluid type heat generator of the fourth embodiment is incorporated in the heating system of an automobile, and when the drive shaft 32 is driven by the automobile engine via, e.g., a belt and pulley transmission mechanism, the rotor element 33 is rotated within the cylindrical fluid-tight heat generating chamber 28. Therefore, the viscous fluid such as silicone oil held in the gap between the inner wall surfaces of the heat generating chamber 28 and the outer faces of the rotor element 33 is subjected to a shearing action by the rotation of the rotor element 33. Consequently, the viscous fluid such as silicone oil generates heat, which is transmitted to a heat exchanging liquid, typically water, flowing through the front and rear heat receiving chambers 36 and 37. Then, the heat is carried by the heat exchanging liquid to a heating circuit of the heating system to warm an objective area of the automobile, such as a passenger compartment.

In the heat generator of the fourth embodiment, after the drive shaft 32 is started to be driven by the automobile engine, the viscous fluid such as silicone oil tends to be collected in the radially inner region of the heat generating chamber 28, i.e., the generally center region of the flat disc-shaped rotor element 33 where the through holes 33*a* are formed, by the Weissenberg effect as well as by the movement of the gaseous material. Especially, it has been found that, when the drive shaft 32 is rotated at a speed lower than a predetermined rotation speed, the Weissenberg effect is stronger than the centrifugal force applied to the viscous fluid.

If the temperature of the viscous fluid such as silicone oil and the gaseous material stored in the heat generation control chamber 38 is lowered below the predetermined level due to, e.g., the lower rotation speed of the rotor element 33, which shows an insufficient heat-generating condition of the heat generator, the flap valve 34 is shifted to close the withdrawing hole 23*c* while the flap valve 35 is shifted to open the supply hole 23*e*. Then, in the heat generating chamber 28, the viscous fluid such as silicone oil is likely to pass through the through holes 33*a* in the rotor element 33, each of which can confront the supply hole 23*e* in the rear plate element 23, and to move between the opposed gap portions of the front and rear sides of the rotor element 33, under the predominant Weissenberg effect.

In this condition, the viscous fluid such as silicone oil is sucked from the heat generation control chamber 38 and supplied into the heat generating chamber 28 through the supply hole 23*e* and the supply channel 23*f*, but it is not expelled from the heat generating chamber 28 through the withdrawing hole 23*c* to the heat generation control chamber 38. Consequently, the amount of the viscous fluid such as silicone oil held in the gap between the inner wall surfaces of the heat generating chamber 28 and the outer faces of the rotor element 33 increases, and the amount of heat generated in the viscous fluid due to the shearing action applied thereto is thereby augmented. In this manner, the heat generating performance of the heat generator is automatically increased, and a sufficient heat-generating condition is established.

On the other hand, when the drive shaft 32 is rotated at a speed higher than the predetermined rotation speed, the viscous fluid such as silicone oil is likely to extend to the radially outer region of the fluid holding gap in the heat generating chamber 28, due to the centrifugal force which becomes stronger than the Weissenberg effect.

If the temperature of the viscous fluid such as silicone oil and the gaseous material stored in the heat generation control chamber 38 is raised above the predetermined level due to, e.g., the higher rotation speed of the rotor element 33, which shows an excessive heat-generating condition of the heat generator, the flap valve 34 is shifted to open the withdrawing hole 23*c* while the flap valve 35 is shifted to close the supply hole 23*e*.

In this condition, the viscous fluid such as silicone oil is expelled from the heat generating chamber 28 and is withdrawn into the heat generation control chamber 38 through the withdrawing channel 23*a* and the withdrawing hole 23*c*, but it is not supplied from the heat generation control chamber 38 through the supply hole 23*e* to the heat generaging chamber 28. Consequently, the amount of the viscous fluid such as silicone oil held in the gap between the inner wall surfaces of the heat generating chamber 28 and the outer faces of the rotor element 33 decreases, and the amount of heat generated from the viscous fluid due to the shearing action applied thereto is thereby reduced. In this manner, the heat generating performance of the heat generator is automatically reduced, and a smaller heat-generation is established.

As described above, the viscous fluid held in the gap defined in the heat generating chamber 28 can be replaced and refreshed by the viscous fluid stored in the heat generation control chamber 38, depending on the temperature of the viscous fluid and the gaseous material stored in the heat generation control chamber 38, so that the same viscous fluid is not always subjected to the shearing action within the heat generating chamber 28, and accordingly, the thermal degradation of the viscous fluid, due to constant heat generation, can be suppressed.

Particularly, in the viscous fluid type heat generator of the fourth embodiment, the withdrawing channel 23*a* recessed on the front face of the rear plate element 23 linearly extends in a radial direction at a position above the rotation axis O of the rotor element 33 to the circumferential wall surface of the heat generating chamber 28. This arrangement of the withdrawing channel 23*a* enables the viscous fluid such as silicone oil extending to the radially outer region of the fluid holding gap in the heat generating chamber 28, especially the viscous fluid flowing along the annular communication gap portion 28*a,* under the predominant centrifugal force especially when the rotor element 33 rotates at a higher speed, to be surely and easily captured by the withdrawing channel 23*a* and withdrawn from the fluid holding gap into the heat generation control chamber 38 through the withdrawing channel 23*a* and the withdrawing hole 23*c,* in the same manner as the fluid withdrawing passageway of the first embodiment.

It will be apparent from the above discussion that the viscous fluid type heat generator of the fourth embodiment possesses other advantages and characteristic effects, similar to those of the heat generator of the first embodiment. In particular, if the rotor element 33 continues to rotate at a high speed, it is possible to prevent the temperature of the viscous fluid to infinitely rise, and thereby eliminate the thermal degradation of the viscous fluid, by reducing the heat generating performance of the heat generator in the manner as described above.

In the embodiments discussed above, it is described that the fluid withdrawing passageway includes a withdrawing channel formed on the front face of the rear plate element of the housing assembly and a withdrawing hole penetrating through the rear plate element and directly communicated with the withdrawing channel. It should be noted that, however, the fluid withdrawing passageway of the present invention is not restricted to this structure, but may be any other structure which may be, e.g., a first withdrawing passageway bored in the rear plate element to open to an outer peripheral region of the heat generating chamber and a second withdrawing passageway bored in the rear plate element to open to radially center region of the heat generating chamber, the first and second withdrawing passageways being directly fluidly communicated with each other, to communicate the outer peripheral region and the radially center region of the heat generating chamber with the additional chamber.

While the invention has been particularly shown and described with reference to preferred embodiments thereof, it will be understood by those skilled in the art that various changes and modifications may be made without departing from the spirit and scope of the invention. The scope of the invention is therefore to be determined solely by the appended claims.

We claim:

1. A viscous fluid type heat generator comprising:

a housing assembly defining therein a heat generating chamber in which heat is generated, an additional chamber communicated through fluid passageway means with said heat generating chamber, and a heat receiving chamber arranged adjacent to said heat generating chamber for permitting a heat exchanging fluid to circulate through said heat receiving chamber to thereby receive heat from said heat generating chamber, said heat generating chamber having inner wall surfaces thereof in which said fluid passageway means opens and forming a fluid-tight chamber together with said additional chamber;

a drive shaft supported by said housing assembly to be rotatable about an axis of rotation of said drive shaft, said drive shaft being operationally connected to an external rotation-drive source;

a rotor element mounted to be rotationally driven by said drive shaft for rotation together with said drive shaft within said heat generating chamber, said rotor element having outer faces confronting said inner wall surfaces of said heat generating chamber via a predetermined gap defined therebetween; and a viscous fluid, held in said gap defined between said inner wall surfaces of said heat generating chamber of said housing assembly and said outer faces of said rotor element, for heat generation by the rotation of said rotor element, and accommodated in said additional chamber of said housing assembly, said viscous fluid being able to flow between said heat generating chamber and said additional chamber through said fluid passageway means;

wherein said additional chamber of said housing assembly is designed to accommodate said viscous fluid, an amount of which is larger than a capacity of said gap defined in said heat generating chamber; and wherein said fluid passageway means comprises a fluid withdrawing passageway for withdrawing said viscous fluid from said gap in said heat generating chamber into said additional chamber and a fluid supply passageway for supplying said viscous fluid from said additional chamber into said gap in said heat generating chamber;

said fluid withdrawing passageway including a withdrawing channel formed in and along one of said inner wall surfaces of said heat generating chamber of said housing assembly, said withdrawing channel extending up to and opening to an outer peripheral region of said heat generating chamber to communicate said outer peripheral region of said heat generating chamber with said additional chamber.

2. The viscous fluid type heat generator of claim 1, wherein said heat generating chamber defines an annular communication gap portion between a circumferential wall surface of said heat generating chamber and a circumferential face of said rotor element to join opposed gap portions disposed at front and rear sides of said rotor element, and wherein said withdrawing channel of said fluid withdrawing passageway opens to and confronts said annular communication gap portion.

3. The viscous fluid type heat generator of claim 1, wherein said fluid withdrawing passageway also opens to a radially center region of said heat generating chamber to communicate said radially center region of said heat generating chamber with said additional chamber.

4. The viscous fluid type heat generator of claim 3, wherein said withdrawing channel of said fluid withdrawing passageway is formed to withdraw a part of said viscous fluid held mainly in said gap in said outer peripheral region of said heat generating chamber when said rotor element rotates at a speed higher than a predetermined rotation speed, while being formed to withdraw a part of said viscous fluid held mainly in said gap in said radially center region of said heat generating chamber when said rotor element rotates at a speed lower than said predetermined rotation speed.

5. The viscous fluid type heat generator of claim 4, wherein said withdrawing channel of said fluid withdrawing passageway has a profile for accelerating a withdrawal of said viscous fluid effected by the rotation of said rotor element from said gap defined in said heat generating chamber into said additional chamber.

6. The viscous fluid type heat generator of claim 5, wherein said heat generating chamber defines an annular communication gap portion between a circumferential wall surface of said heat generating chamber and a circumferential face of said rotor element to join opposed gap portions disposed at front and rear sides of said rotor element, and wherein said withdrawing channel of said fluid withdrawing passageway opens to and confronts said annular communication gap portion.

7. The viscous fluid type heat generator of claim 6, wherein said withdrawing channel of said fluid withdrawing passageway is recessed in said one of inner wall surfaces of said heat generating chamber to open over substantially an entire length of said withdrawing channel to said heat generating chamber, and linearly extends along a center line of said withdrawing channel, said center line being angularly shifted from a radial line of said one inner wall surface in a direction opposed to a rotation direction of said rotor element.

8. The viscous fluid type heat generator of claim 6, wherein said withdrawing channel of said fluid withdrawing passageway is recessed in said one of inner wall surfaces of said heat generating chamber to open over substantially an entire length of said withdrawing channel to said heat generating chamber, and curvedly extends along a center line of said withdrawing channel, said center line being concavely curved from a radial line of said one inner wall surface in a direction opposed to a rotation direction of said rotor element.

9. The viscous fluid type heat generator of claim 6, wherein said withdrawing channel of said fluid withdrawing passageway is recessed in said one of inner wall surfaces of said heat generating chamber to open over substantially an entire length of said withdrawing channel to said heat generating chamber, and is provided with a chamfered opening edge at an upstream side in a rotation direction of said rotor element.

10. The viscous fluid type heat generator of claim 3, wherein said fluid withdrawing passageway also includes a withdrawing hole opening to a radially center region of said heat generating chamber to communicate said radially center region of said heat generating chamber with said additional chamber, said withdrawing hole being directly communicated with said withdrawing channel.

11. The viscous fluid type heat generator of claim 1, wherein said fluid supply passageway and said fluid withdrawing passageway are designed to constantly open a fluidic communication between said heat generating chamber and said additional chamber during the rotation of said rotor element.

12. The viscous fluid type heat generator of claim 1, wherein at least one of said fluid supply passageway and said fluid withdrawing passageway is designed to selectively open and close a fluidic communication between said heat generating chamber and said additional chamber during the rotation of said rotor element.

13. The viscous fluid type heat generator of claim 1, wherein said fluid withdrawing passageway opens to said additional chamber at a position above a fluid level of said viscous fluid accommodated in said additional chamber, and wherein said fluid supply passageway opens to said additional chamber at a position below said fluid level of said viscous fluid accommodated in said additional chamber.

14. The viscous fluid type heat generator of claim 1, wherein said rotor element is shaped as a flat plate including a portion extending radially outward from said drive shaft.

15. The viscous fluid type heat generator of claim 1, wherein said rotor element includes a through hole formed through a radially center region of said rotor element and extending between axially opposed faces of said rotor element.

16. A viscous fluid type heat generator comprising:

a housing assembly defining therein a heat generating chamber in which heat is generated, an additional chamber communicated through fluid passageway means with said heat generating chamber, and a heat receiving chamber arranged adjacent to said heat generating chamber for permitting a heat exchanging fluid to circulate therethrough to thereby receive heat from said heat generating chamber, said heat generating chamber having inner wall surfaces thereof in which said fluid passageway means opens and forming a fluid-tight chamber together with said additional chamber;

a drive shaft supported by said housing assembly to be rotatable about an axis of rotation thereof, said drive shaft being operationally connected to an external rotation-drive source;

a rotor element mounted to be rotationally driven by said drive shaft for rotation together therewith within said heat generating chamber, said rotor element having outer faces confronting said inner wall surfaces of said heat generating chamber via a predetermined capacity of gap defined therebetween; and a viscous fluid, held in said gap defined between said inner wall surfaces of said heat generating chamber of said housing assembly and said outer faces of said rotor element, for heat generation by the rotation of said rotor element, and accommodated in said additional chamber of said housing assembly, said viscous fluid being able to flow between said heat generating chamber and said additional chamber through said fluid passageway means;

wherein said additional chamber of said housing assembly is designed to accommodate said viscous fluid, an amount of which is larger than the capacity of said gap defined in said heat generating chamber; and wherein said fluid passageway means comprises a fluid withdrawing passageway for withdrawing said viscous fluid from said gap in said heat generating chamber into said additional chamber and a fluid supply passageway for supplying said viscous fluid from said additional chamber into said gap in said heat generating chamber;

said fluid withdrawing passageway including a first withdrawing passageway opening to an outer peripheral region of said heat generating chamber and a second withdrawing passageway opening to a radially center region of said heat generating chamber, said first and second withdrawing passageways being directly fluidly communicated with each other, to communicate said outer peripheral region and said radially center region of said heat generating chamber with said additional chamber.

17. The viscous fluid type heat generator of claim 16, wherein said second withdrawing passageway comprises a withdrawing hole opening at one end to said radially center region of said heat generating chamber and at another end to said additional chamber, and wherein said first withdrawing passageway comprises a withdrawing channel formed in and along one of said inner wall surfaces of said heat generating chamber, said withdrawing channel extending from said withdrawing hole up to said outer peripheral region of said heat generating chamber.

18. The viscous fluid type heat generator of claim 17, wherein said rotor element is shaped as a flat plate including a portion extending radially outward from said drive shaft.

19. The viscous fluid type heat generator of claim 18, wherein said withdrawing channel of said fluid withdrawing passageway is recessed in said one of inner wall surfaces of said heat generating chamber to open over substantially an entire length of said withdrawing channel to said heat generating chamber, and linearly extends along a center line of said withdrawing channel, said center line being angularly shifted from a radial line of said one inner wall surface in a direction opposed to a rotation direction of said rotor element.

* * * * *